United States Patent [19]

Hanell et al.

[11] 4,314,250

[45] Feb. 2, 1982

[54] INTERMODULATION PRODUCT SUPPRESSION BY ANTENNA PROCESSING

[75] Inventors: Sigmund H. Hanell, Vernouillet, France; Randall W. Kreutel, Jr., Rockville, Md.

[73] Assignee: Communications Satellite Corporation, Washington, D.C.

[21] Appl. No.: 63,887

[22] Filed: Aug. 3, 1979

[51] Int. Cl.[3] ..... H01Q 3/36

[52] U.S. Cl. ..... 343/100 SA

[58] Field of Search ..... 343/100 SA

[56] References Cited

U.S. PATENT DOCUMENTS 3,560,985 2/1971 Lyon ..... 343/100 SA X 4,216,475 8/1980 Johnson ..... 343/100 SA

*Primary Examiner*—T. H. Tubbesing

*Attorney, Agent, or Firm*—Sughrue, Mion, Zinn, Macpeak & Seas

[57] ABSTRACT

Intermodulation product frequency signals in an active phased-array antenna are spacially filtered by using the beam forming and steering network as a processor to select the intermodulation beam pointing directions such that they will not interfere with the desired beams.

7 Claims, 2 Drawing Figures

INTERMODULATION PRODUCT SUPPRESSION BY ANTENNA PROCESSING

BACKGROUND OF THE INVENTION

This invention relates to multiple-beam phased-array antennae, and more particularly, to such antennae of the active type in which an amplifier is provided for each radiating element within the array. The invention is directed to the problem of intermodulation product beams which are characteristic of such antennae.

Active, phase-array antennae are well known in the art and are disclosed, for example, in U.S. Pat. Nos. 3,618,097 and 3,662,385. A simplified block diagram of certain essential components of such a phased-array antenna is shown in FIG. 1. The control circuit 10 provides at its output line 12 a carrier wave modulated with information. By controlling the time at which the modulated carrier arrives at each radiating element 14, the direction in which the signal is transmitted can be controlled. The direction of the transmitted beam will be primarily a function of the spacing interval between adjacent elements 14 and the phase difference between the signals present at consecutive radiating elements. For example, if the inter-element spacings and phase difference are selected to that the signals radiated from each element are in phase at points A–E, the beam will be transmitted in the direction of the normal to the line A–E. Thus, the beam transmitting direction will form an angle $\alpha$ with respect to the normal 16 to the radiating element array. If the phase difference between successive radiating elements is slightly decreased, the angle $\alpha$ will decrease and the beam direction will rotate counterclockwise as shown in FIG. 1.

The phase shift between consecutive radiating elements is accomplished, in part, by the longer signal path which the signal on line 12 must traverse in order to arrive at each element 14. However, the required additional control is typically provided by a plurality of phase shifters 18 which are controlled by the control circuit 10 in order to accomplish beam steering.

Although FIG. 1 illustrates only a single row of five radiating elements, it should be easily appreciated that any number of radiating elements 14 are possible. Further, although FIG. 1 illustrates only a single row of elements which provide only a single degree of beam steering capability, phased-array antennae typically comprise a plurality of such rows with a controllable phase shift between consecutive rows in order to provide two degrees of beam steering capability. It is also typical to utilize a single phased-array antenna to transmit a plurality of beams having different carrier wave frequencies.

In order to provide the required power output at each radiating element, amplifiers 20 are included in the phased-array. The amplifiers 20 are generally operated in a nonlinear mode. As is well known in the art, a nonlinear amplifier receiving signals of two different frequencies will provide outputs at each of those two frequencies as well as intermodulation product outputs at the sum and difference frequencies of those two signals. In an active phased-array antenna having multiple beams, a plurality of intermodulation product signals are present at each of the radiating elements 14. These intermodulation products will result in intermodulation beams which may interfere with the desired beams. This is a significant problem in active phased-array multiple-beam antennae.

There are two known techniques for alleviating the problem of intermodulation products in array antennae. One, of course, is to operate the amplifiers 20 in a linear mode so that intermodulation products are not generated, or are at least held to a tolerable level. This solution is unacceptable because linear amplifiers have a low DC-to-RF efficiency which will significantly hinder the operation of the array.

A second known technique is a special method of frequency staggering known as Babcock spacing, disclosed in an article, "Intermodulation Interference in Radio Systems", by W. C. Babcock, *Bell Systems Technical Journal*, January 1953. According to the Babcock technique, the carrier waves are unequally spaced in frequency so that all intermodulation products can be frequency-domain filtered. The obvious disadvantage of such a technique is that it results in an undesired spreading of the frequency band occupied by the multiple beams and, consequently, an inefficient use of the available frequency spectrum.

There is a need, then, for a more efficient technique for eliminating troublesome intermodulation products from active phased-array multiple-beam antennae.

SUMMARY OF THE INVENTION

It is an object of the present invention to effectively prevent interference between desired beams and intermodulation product beams in an active phased-array multiple-beam antenna.

It is a further object of this invention to eliminate these intermodulation product beams without incurring the disadvantages in the above-described intermodulation product suppression techniques.

Briefly, in accordance with the present invention, these and other objects are achieved by designing the antenna parameters, e.g., the number of beams, number of radiating elements, beam directions, phase tilts across the array, and element spacing, so that, for carriers which are equally spaced in frequency, a substantial degree of spacial filtering can be achieved by the antenna, and these spacial filtering characteristics of the array can be effectively used to reduce the intermodulation interference.

DETAILED DESCRIPTION OF THE INVENTION

Figure 1:
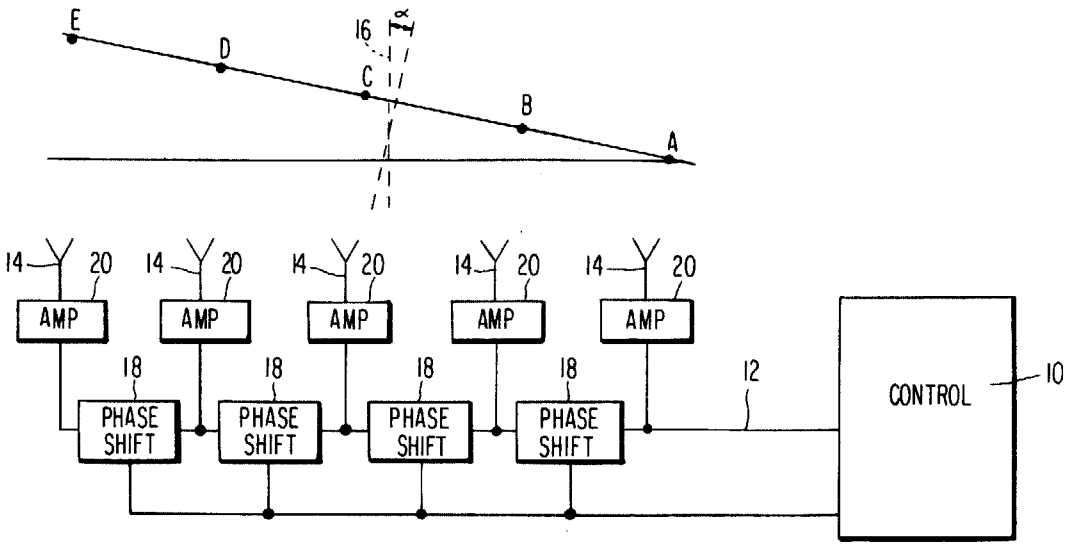
FIG. 1 is a simplified block diagram of an active phased-array multiple-beam antenna.

The present invention can best be understood through the analytical discussion hereinbelow. In this discussion, the phase "active array" is used to refer to a phased array antenna as described hereinabove in which each radiating element is connected directly to an amplifier.

Consider a uniform array antenna of $N_x \times N_y$ radiating elements. Each radiating element is connected directly to an amplifier and the amplifiers are, in turn, collectively connected to a beam forming and steering control circuit. The beam forming and steering control circuit is capable of forming N independently pointed beams. It accomplishes this by generating a set of linearly progressive phase shifts to the elements of the array. If it is assumed that the radiating elements are driven with equal amplitudes then the radiation pattern of the nth antenna beam has the normalized form:

$$E_n(\theta_x,\theta_y) = \frac{1}{N_xN_y}\left[\frac{\sin\frac{N_x}{2}(k\,d_x\sin\theta_x - \alpha_x)}{\frac{1}{2}(k\,d_x\sin\theta_x - \alpha_x)}\right]\left[\frac{\sin\frac{N_y}{2}(k\,d_y\sin\theta_y - \alpha_y)}{\frac{1}{2}(k\,d_y\sin\theta_y - \alpha_y)}\right] \quad (1)$$

where:

$k=2\pi/\lambda$;

$\lambda$ is the free space wavelength of the nth carrier, $d_y$=element spacing in the y direction, $d_x$=element spacing in the x direction, $\alpha_x$=progressive phase shift in the x direction, $\alpha_y$=progressive phase shift in the y direction, and $\theta_x,\theta_y$=angles in the x and y directions respectively, from the array normal.

The peak of the pattern given by equation (1) occurs for:

$$\theta_{xon} = \sin^{-1}\frac{\lambda\alpha_x}{2\pi\,d_x} \quad (2)$$

$$\theta_{yon} = \sin^{-1}\frac{\lambda\alpha_y}{2\pi\,d_y}$$

For a system in which N beams are formed by the array antenna and each beam contains one carrier, there are N carriers appearing at the inputs to each of $N_x \times N_y$ amplifiers. For the case of unmodulated carriers the composite input signal to the mlth amplifier has the form:

$$(e_{in})_{ml} \sum_{n=1}^{N} a_n\sin(w_nt + \psi_n + m\alpha_{xn} + l\alpha_{jn}) \quad (3)$$

where:

$a_n$ is the amplitude of the nth carrier, $w_n$ is the radian frequency of the nth carrier, $\psi_n$ is an arbitrary phase term of the nth carrier, $\alpha_{xn}$ is the x directed progressive phase shift of the nth carrier, and $\alpha_{yn}$ is the y directed progressive phase shift of the nth carrier.

$\alpha_{xn}$ and $\alpha_{yn}$ are used with equation (2) to define the pointing direction of the beam for the nth carrier.

The amplifiers will, in general, have a non-linear input-output characteristic. The non-linearity will typically result in AM-PM and intermodulation distortion to the amplified signals. This invention is concerned with the suppression of only the intermodulation distortion.

The output signal from the generalized mlth amplifier will have the form:

$$(e_{out})_{ml} = C\sum_{n=1}^{N} a_n\sin(w_nt + m\alpha_{xn} + l\alpha_{yn}) + \frac{1}{2}\,Re\sum_{k_1,k_2\ldots K_N=-\infty}^{\infty} A_{k_1,k_2\ldots k_N}\,e^{j(k_1w_1+k_2w_2+\ldots+k_Nw_N)t}\cdot e^{jm(k_1\alpha_{x1}+k_2\alpha_{x2}+\ldots+k_N\alpha_{xN})}\cdot e^{jl(k_1\alpha_{y1}+k_2\alpha_{y2}+\ldots+k_N\alpha_{yN})} \quad (4)$$

where the constants $k_1, k_2 \ldots k_N$ can be any positive or negative integer or zero subject to the constraint $$k_1+k_2+\ldots k_N=1 \quad (5)$$

In deriving equation (4) the $\psi_n$ were taken as zero for convenience and only in-band intermodulation products are considered, since any out-of-band products can be easily frequency domain filtered. In equation (4), C is the voltage gain and $A_{k1,k2\ldots kN}$ is the amplitude of the intermodulation product.

The intermodulation signals, thus appear at frequencies given by:

$$w_i=k_1w_1+k_2w_2+\ldots+k_Nw_N \quad (6)$$

where the constants can take on any values satisfying equation (5).

The intermodulation signals are radiated into antenna beams spacially located by equation (2) with:

$$\alpha_{xi} = k_1\alpha_{x1} + k_2\alpha_{x2} + \ldots + k_N\alpha_{xN} \quad (7)$$
$$\alpha_{yi} = k_1\alpha_{y1} + k_2\alpha_{y2} + \ldots + k_N\alpha_{yN}$$

If the antenna field of view is small (such as, for example, an earth looking antenna on a synchronous satellite) and $\Delta\lambda$ is small compared to $\lambda$ (i.e., the change in wavelength over the signal bandwidth can be neglected) then the spatial directions of the intermodulation beams can be written:

$$\theta_{xi} \cong k_1\theta_{x1} + k_2\theta_{x2} + \ldots + k_N\theta_{xN} \quad (8)$$

$$\theta_{yi} \cong k_1\theta_{y1} + k_2\theta_{y2} + \ldots + k_N\theta_{yN}$$

Where the $\theta_{xn}$, $\theta_{yn}$ are the spacial pointing directions of the nth desired beam containing the signal frequency $w_n$.

Equation (8) indicates that generally ($\theta_{xi}$, $\theta_{yi}$) will not equal ($\theta_{xn}$, $\theta_{yn}$).

The intermodulation products which are of special concern are those for which $w_i=w_n$, i.e., the intermodulation product occurs at one of the carrier frequencies. According to equation (8), however, $w_i$ will generally be radiated in different spacial direction than $W_n$. Thus, it is seen that the spacial filtering properties of the active phased array antennas can be used effectively to reduce intermodulation interference.

The clear similarity between the expressions for the intermodulation frequencies (equation (6)) and the expressions (8) defining the angular location of the antenna beam radiating the intermodulation signal indicates that the frequency domain techniques for reducing intermodulation interference can also be applied to the space domain. It is this similarity which forms the basis for effective utilization of the spacial filtering character of the active phased array. Two simple examples will help illustrate this more clearly.

Consider first the special case where all N antenna beams point in the same direction. In this case it is clear that the antenna provides no spacial filtering and that the harmful effects of intermodulation can be eliminated by unequal frequency spacing of the N signals (staggered frequency plan, or Babcock spacing) so that the intermodulation products could be frequency domain filtered. This results, however, in an undesired spreading of the frequency band which is occupied by the N signals.

Now consider the case where the N carriers are equally spaced in frequency. By equation (8) the N corresponding beam directions are chosen such that the intermodulation signals radiate in directions which will not harmfully interfere with the desired signals. In view of the similarity between equation (6) and (8), the method of distributing the antenna beams in space is similar to the frequency spreading employed in the first example except that it is the spacial pointing directions, rather than the frequencies, of the intermodulation beams which are being controlled.

Equation (8) is a generalized equation for the spacial pointing direction of each intermodulation beam. Since the only constraint upon the values of the constants in the equations for $\theta_{xi}$ and $\theta_{yi}$ are that the constants in each equation must add up to a total of 1 (thus limiting our consideration to only in-band intermodulation beams), the number of intermodulation beams will be determined by the number of permutations of $k_1$-$k_N$, where the possible values of the constants are +1, 0, or −1, which will satisfy equation (5). This, of course increases dramatically as the number of carriers increases, but the use of readily available calculators or computers would permit the easy computation of the spacial pointing directions of the intermodulation beams of interest. With the help of the above equations, the antenna parameters, e.g., the number of desired beams which are radiated, the number of radiating elements, the directions of respective desired beams, the magnitudes of the phase tilt across the array and the spacing of the radiating elements, can be selected to that the minimum possible overlap will occur between the radiation patterns of the desired beams and intermodulation product beams.

It should be noted that the frequencies of the respective carriers was not included in the above list of antenna parameters which will affect the spacial pointing directions of the desired intermodulation product beams. This is due to the assumption hereinabove that the field of view of the antenna is small and that the change in wavelength over the signal band width is negligible.

In the analysis hereinabove, only the location of beam peaks has been considered. To fully assess the utility of the spacial filtering property of the active array according to the present invention, the shape of the beam patterns must be considered. The reason for this is that it will not always be possible to completely cancel the intermodulation signals appearing at the desired carrier frequency and, therefore, the improvement in the carrier to intermodulation interference ratio (C/I) realized through the spacial shape of the beam pattern is more properly the criterion for evaluating the present invention. Thus, the shape of the antenna pattern plays a significant role in determining the filtering potential of the antenna.

The improvement in C/I at the frequency $w_n$ resulting from the spacial filtering property of the active phased array is defined as $\Delta(\theta_x,\theta_y)_{wn}$ and is given by:

$$\Delta(\theta_x,\theta_y)_{wn} = \frac{F(\theta_x,\theta_y)^2}{\sum_{j=1}^{M} (\beta_j)^2 \, |I_j(\theta_x,\theta_y)|^2{}_{wn}} \tag{9}$$

where:

$F(\theta_x,\theta_y)$ is the voltage radiation pattern of the desired beam at frequency $w_n$, $I_j(\theta_x,\theta_y)$ is the radiation pattern of the $j^{th}$ intermodulation beam at frequency $w_n$ M is the number of intermodulation signals at frequency $w_n$, and $\beta_j$ is the relative voltage gain of the intermodulation beams ($\beta_j \leqq 1$).

$F(\theta_x,\theta_y)$ defines the shape of the antenna pattern and is controlled by the amplitude distribution of the array aperture as is well known in the art. For uniform illumination it is given by equation (1) hereinabove. The intermodulation product radiation pattern $I_j(\theta_x,\theta_y)$ will have the same basic shape as $F(\theta_x,\theta_y)$ but will be pointed at a different angle.

The total available C/I in the direction $\theta_x,\theta_y$ is obtained by adding $\Delta(\theta_x,\theta_y)_{wn}$ in dB to the C/I in dB which is measured at the output of a single amplifier. It is assumed that all amplifiers have identical input/output characteristics.

NUMERICAL EXAMPLE

A uniformly illuminated linear array antenna is used in which each radiating element is connected to an amplifier. The input to the array is a set of three equally spaced carriers which are radiated into three independent beams. For the purposes of this analysis, it is assumed that the amplifiers are non-linear and that all intermodulation products except those due to the third order non-linearity can be neglected, which is generally true. The properties of this system including the carrier frequencies, the desired beam locations, the third order products and their associated beam direction are listed in Table 1. The angle $\theta$ is measured from the normal to the plane containing the array and is measured in the plane containing the array.

TABLE 1

| Carrier Frequency | Pointing Direction of Desired Beam | 3rd Order Intermodulation Frequency | Pointing Direction of the 3rd Order intermodulation Beam |
|---|---|---|---|
| $f_1$ | $\theta_1$ | $2f_2 - f_3$ | $2\theta_2 - \theta_3$ |
| $f_2$ | $\theta_2$ | $f_1 + f_3 - f_2$ | $\theta_1 + \theta_3 - \theta_2$ |
| $f_3$ | $\theta_3$ | $2f_2 - f_1$ | $2\theta_2 - \theta_1$ |

The radiation pattern function $F(\theta)$ for the desired beams and $I(\theta)$ for the intermodulation beams as well as the C/I improvement factor $\Delta(\theta)$ are listed in Table 2.

TABLE 2

| Frequency slot | $f_1$ | $f_2$ | $f_3$ |
|---|---|---|---|
| Desired beam* ($F(\theta)$) | $\frac{\sin\xi(\theta - \theta_1)}{\xi(\theta - \theta_1)}$ | $\frac{\sin\xi(\theta - \theta_2)}{\xi(\theta - \theta_2)}$ | $\frac{\sin\xi(\theta - \theta_3)}{\xi(\theta - \theta_3)}$ |

TABLE 2-continued

| Frequency slot | $f_1$ | $f_2$ | $f_3$ |
|---|---|---|---|
| Inter-modulation Beam ($I(\theta)$) $\Delta(\theta)$ | $\frac{\sin\xi(\theta - 2\theta_2 + \theta_3)}{\xi(\theta - 2\theta_2 + \theta_3)}$ | $\frac{\sin\xi(\theta - \theta_1 - \theta_3 + \theta_2)}{\xi(\theta - \theta_1 - \theta_3 + \theta_2)}$ | $\frac{\sin\xi(\theta - 2\theta_2 + \theta_3)}{\xi(\theta - \theta_2 + \theta_3)}$ |
| $\left[\frac{F(\theta)}{I(\theta)}\right]^2$ | $\left[\frac{\xi(\theta - 2\theta_2 + \theta_3)\sin\xi(\theta - \theta_1)}{\xi(\theta - \theta_1)\sin\xi(\theta - 2\theta_2 + \theta_3)}\right]^2$ | $\left[\frac{\xi(\theta - \theta_1 - \theta_3 + \theta_2)\sin\xi(\theta - \theta_2)}{\xi(\theta - \theta_2)\sin\xi(\theta - \theta_1 - \theta_3 + \theta_2)}\right]^2$ | $\left[\frac{\xi(\theta - 2\theta_2 + \theta_3)\sin\xi(\theta - \theta_3)}{\xi(\theta - \theta_3)\sin\xi(\theta - 2\theta_2 + \theta_3)}\right]^2$ |

$\frac{\lambda dN}{\lambda}$, d = distance between adjacent radiating elements,
N = number of radiating elements in the array,
$\lambda$ = the wavelength ($\lambda_1 \cong \lambda_2 \cong \lambda_3$).

In deriving the expression for $\Delta(\theta)$ by equation (9), M is taken as one (since there are three equally spaced carriers) and $\beta_j$ is assumed equal to one. This assumption is valid since there is only one intermodulation signal on each desired carrier.

Figure 2:
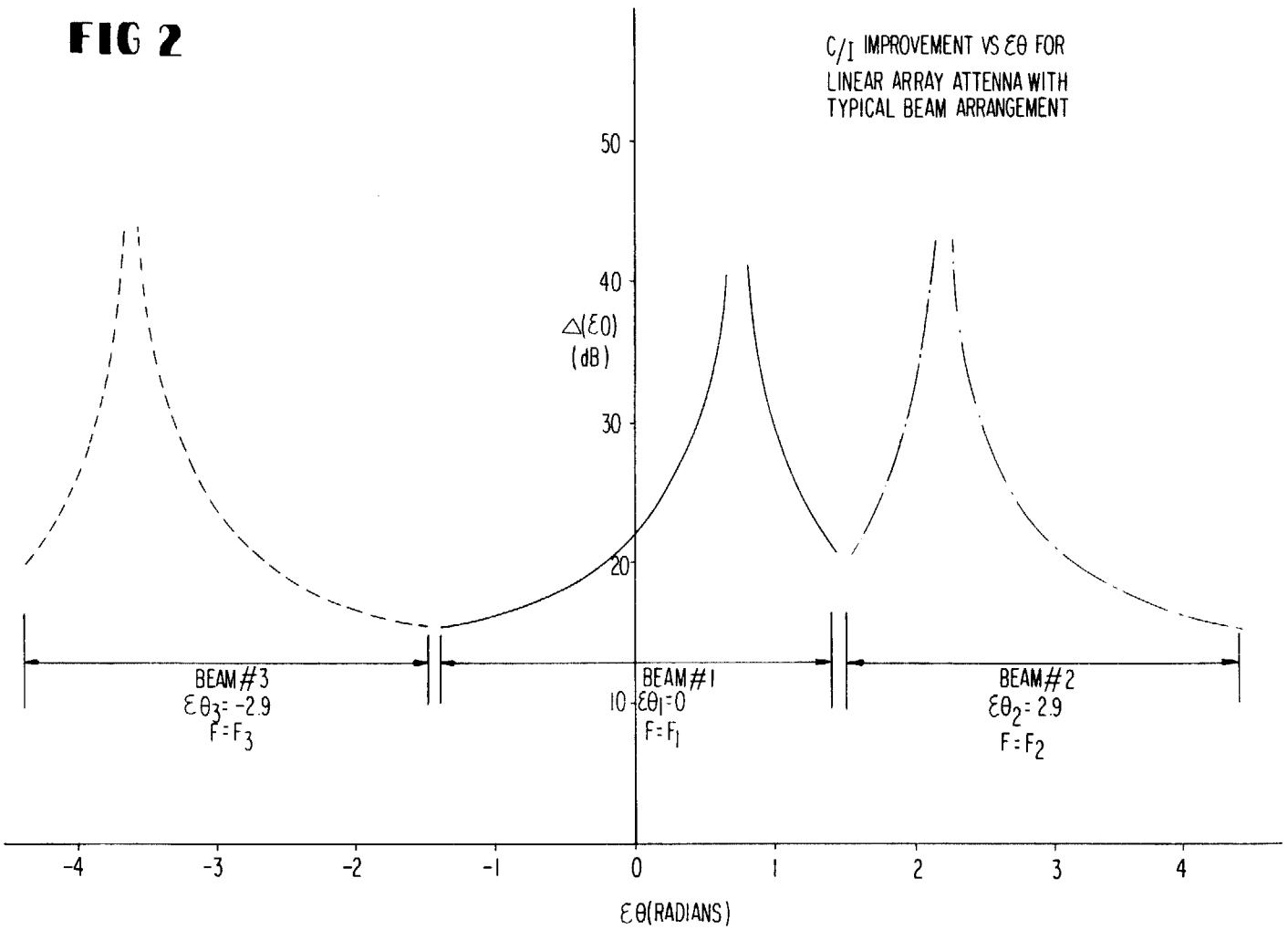
FIG. 2 is a graph for the carrier-to-intermodulation interference ratio (C/I) when the intermodulation product suppression technique of the present invention is employed in a typical antenna beam arrangement.

The C/I improvement factors listed in Table 2 have been evaluated for a typical antenna beam arrangement and are plotted in FIG. 2. The beams are located at $\xi\theta_1=0$, $\xi\theta_2=2.9$ and $\xi\theta_3=-2.9$ and the C/I improvement is plotted versus $\xi\theta$. Normalizing the space angle in this manner permits application of the results to any uniformly illuminated linear array. In FIG. 2, the C/I improvement is plotted over the half-power beamwidth of each beam. It is noted that the worst case improvement is approximately 15 dB.

The C/I measured directly at the output of an amplifier operating at saturation would typically fall in the range 9 to 12 dB. For the antenna typified by FIG. 1, this value of C/I is improved by at least 15 dB. Therefore, the resultant C/I anywhere within the half-power beam width of the antenna is greater than 24 dB.

It will, of course, be appreciated that any given situation will dictate the amount of C/I which will be acceptable and this, in turn, will determine the eventual antenna design. Once the above analysis has been presented to a person of ordinary skill in the art of antenna design, it would be well within his capabilities to design an antenna having the desired degree of spacial filtering characteristics which would satisfy his particular situation.

It should also be appreciated that, as can be seen from equation (8), the spacial pointing directions of the intermodulation product beams will be affected by beam steering of the desired radiated beams. In other words, altering the progressive phase tilt across the antenna array in order to change the beam direction ($\theta_{x2}$, $\theta_{y2}$) of the second carrier will result in a corresponding change of the spacial pointing directions of those intermodulation product beams for which the constants $k_2$ are nonzero. Accordingly, it will also be up to each particular user to determine how much beam steering can be permitted before the C/I becomes unacceptable.

What is claimed is:

1. In a method of fabricating an active phased-array, multiple-beam antenna for radiating a plurality of N desired beams from a plurality of N carriers, each of said desired beams having a carrier frequency $w_n$, $1 \leqq n \leqq N$, said method including the steps of connecting said plurality of radiating elements to the output terminals of respective non-linear amplifiers with an inter-element spacing of $d_x$ in an x direction and $d_y$ in a y direction and connecting to said nonlinear amplifiers a means for generating a phase tilt of said carriers across said array of spaced radiating elements, said phase tilt having a value $\alpha_x$ in said x direction and $\alpha_y$ in said y direction, the improvement comprising:

determining, for each carrier frequency $w_n$, all possible permutations of $k_1, k_2, \ldots, k_N$ for which $w_i=w_n$, where $w_i$ is an intermodulation product frequency given by $$w_i=k_1w_1+k_2w_2+\ldots+k_Nw_N$$

and $k_1, k_2, \ldots, k_N$ are constants which can be any positive or negative integer or 0 subject to the constraint $$k_1+k_2+\ldots k_N=1;$$

inserting said determined permutations into the equation $$\theta_{xi}\cong k_1\theta_{x1}+k_2\theta_{x2}+\ldots+k_N\theta_{xN}$$

$$\theta_{yi}\cong k_1\theta_{y1}+k_2\theta_{y2}+\ldots+k_N\theta_{yN}$$

to determine the pointing direction ($\theta_{xi}$, $\theta_{yi}$) of each intermodulation product beam having a carrier frequency $w_i=w_n$, where ($\theta_{xn}$, $\theta_{yn}$) is the pointing direction of a desired beam having a carrier frequency $w_n$; and adjusting the pointing directions ($\theta_{xn}$, $\theta_{yn}$) of the desired beams such that the pointing directions ($\theta_{xi}$, $\theta_{yi}$) of each intermodulation product beam for which $w_i=w_n$ will differ from the pointing direction ($\theta_{xn}$, $\theta_{yn}$) of the desired beam having that same carrier frequency $w_n$.

2. A method of reducing interference between desired radiated beams and intermodulation product beams in an active phased-array multiple-beam antenna for radiating a plurality of N desired beams from a plurality of N carriers, each of said desired beams having a carrier frequency $w_n$, $1 \leqq n \leqq N$, said antenna being of the type in which a plurality of radiating elements are coupled to the output terminals of respective non-linear amplifiers with an inter-element spacing of $d_x$ in an x direction and $d_y$ in a y direction and in which phase tilt means is connected to said non-linear amplifiers for generating a phase tilt of said carriers across said array of spaced radiating elements, said phase tilt having a value $\alpha_x$ in said x direction and $\alpha_y$ in said y direction, said method comprising:

determining, for each carrier frequency $w_n$, all possible permutations of $k_1, k_2, \ldots, k_N$ for which $w_i = w_n$, where $w_i$ is an intermodulation product frequency given by $$w_i = k_1 w_1 + k_2 w_2 + \ldots + k_N w_N$$

and $k_1, k_2, \ldots, k_N$ are constants which can be any positive or negative integer or 0 subject to the constraint $$k_1 + k_2 + \ldots k_N = 1;$$

inserting said determined permutations into the equation $$\theta_{xi} \cong k_1\theta_{x1} + k_2\theta_{x2} + \ldots + k_N\theta_{xN}$$

$$\theta_{yi} \cong k_1\theta_{y1} + k_2\theta_{y2} + \ldots + k_N\theta_{yN}$$

to determine the pointing direction $(\theta_{xi}, \theta_{yi})$ of each intermodulation product beam having a carrier frequency $w_i = w_n$, where $(\theta_{xn}, \theta_{yn})$ is the pointing direction of a desired beam having a carrier frequency $w_n$; and adjusting the pointing directions $(\theta_{xn}, \theta_{yn})$ of the desired beams such that the pointing directions $(\theta_{xi}, \theta_{yi})$ of each intermodulation product beam for which $w_i = w_n$ will differ from the pointing direction $(\theta_{xn}, \theta_{yn})$ of the desired beam having that same carrier frequency $w_n$.

3. The method as defined in either one of claims 1 or 2, wherein said pointing directions $(\theta_{xn}, \theta_{yn})$ of said desired beams are adjusted by adjusting antenna design parameters such as the number of desired beams which are radiated, the number of said radiating elements, the magnitude of said phase tilt and the spacing of said radiating elements.

4. The method according to claims 1 or 2, wherein said pointing directions $(\theta_{xn}, \theta_{yn})$ of said desired beams are adjusted to maximize $\Delta(\theta_x, \theta_y)_{wn}$ given by:

$$\Delta(\theta_X, \theta_y)_{wn} = \frac{F(\theta_x, \theta_y)^2}{\sum_{j=1}^{M} \beta_j^2 I_j(\theta_x, \theta_y)^2 w_n}$$

where:

$F(\theta_x, \theta_y)$ is the voltage radiation pattern of the desired beam at frequency $w_n$, $I_j(\theta_x, \theta_y)$ is the radiation pattern of the $j^{th}$ intermodulation beam at frequency $w_n$ M is the number of intermodulation signals at frequency $w_n$, and $\beta_j$ is the relative voltage gain of the intermodulation beams $(\beta_j \leqq 1)$.

5. The method according to claims 1 or 2, wherein said plurality of N carriers are equally spaced in frequency.

6. An active phase-array multiple-beam antenna for radiating a plurality of N desired beams from a plurality of N carriers, each of said desired beams having a carrier frequency $w_n$, $1 \leqq n \leqq N$, said antenna having a plurality of spaced radiating elements separated by $d_x$ in an x direction and $d_y$ in a y direction each of which is connected to an output of a respective non-linear amplifier, each of said non-linear amplifiers generating intermodulation products, and means for generating a phase tilt of said multiple carriers across said plurality of radiating elements, said phase tilt having a value of $\alpha_x$ in the x direction and $\alpha_y$ in the y direction, said antenna generating intermodulation product beams having carrier frequencies given by $$w_i = k_1 w_1 + k_2 w_2 + \ldots + k_N w_N$$

where the constants $k_1, k_2, \ldots, k_N$ can be any positive or negative integer or 0 subject to the constraint $$k_1 + k_2 + \ldots k_N = 1,$$

said antenna being characterized in that, for each interfering intermodulation product beam having a carrier frequency $w_i$ equal to one of said desired beam carrier frequencies $w_n$, the pointing direction $(\theta_{xi}, \theta_{yi})$ of said interfering intermodulation product beam given by $$\theta_{xi} \cong k_1\theta_{x1} + k_2\theta_{x2} + \ldots + k_N\theta_{xN}$$

$$\theta_{yi} \cong k_1\theta_{y1} + k_2\theta_{y2} + \ldots + k_N\theta_{yN}$$

where $(\theta_{xn}, \theta_{yn})$ is the pointing direction of the desired beam having carrier frequency $w_n$, is different from the pointing direction $(\theta_{xn}, \theta_{yn})$ of the desired beam having that same carrier frequency $w_n$.

7. The antenna according to claim 6, wherein said plurality of N carriers are equally spaced in frequency.

* * * * *